US005682870A

United States Patent [19]

Motoyama

[11] Patent Number: 5,682,870

[45] Date of Patent: Nov. 4, 1997

[54] AIR FUEL RATIO DETECTING DEVICE AND SYSTEM FOR ENGINES

[75] Inventor: Yu Motoyama, Iwata, Japan

[73] Assignee: Yamaha Hatsudoki Kabushiki Kaisha, Twata, Japan

[21] Appl. No.: 579,873

[22] Filed: Dec. 28, 1995

[30] Foreign Application Priority Data

Dec. 28, 1994 [JP] Japan ..... 6-328739

[51] Int. Cl.[6] ..... F01N 3/00; F02D 41/14

[52] U.S. Cl. ..... 123/703; 60/276

[58] Field of Search ..... 123/672, 703; 60/276

[56] References Cited

U.S. PATENT DOCUMENTS

| | | | |
|---|---|---|---|
| 3,962,866 | 6/1976 | Neidhard et al. | 60/276 |
| 4,145,881 | 3/1979 | Poullot | 60/276 |
| 4,601,276 | 7/1986 | Damson et al. | 123/672 |
| 4,617,795 | 10/1986 | Abthoff et al. | 60/276 |
| 4,752,361 | 6/1988 | Gautschi | 60/276 |
| 4,831,820 | 5/1989 | Lassanske | 60/276 |
| 4,903,648 | 2/1990 | Lassankse | 123/65 R |
| 5,241,853 | 9/1993 | Tsui et al. | 73/116 |
| 5,265,417 | 11/1993 | Visser et al. | 60/276 |

OTHER PUBLICATIONS

European Search Report dated Apr. 19, 1996, EP 95 12 0608.

*Primary Examiner*—Willis R. Wolfe

*Attorney, Agent, or Firm*—Knobbe, Martens, Olson & Bear LLP

[57] ABSTRACT

A number of embodiments of combustion controls for two-cycle internal combustion engines wherein a sensor chamber is provided in which a combustion condition sensor is located. The sensor chamber communicates with the combustion chamber in such a way that only combustion products can flow from the combustion chamber into the sensor chamber. Various valving and control arrangements for achieving this purpose are disclosed.

24 Claims, 12 Drawing Sheets

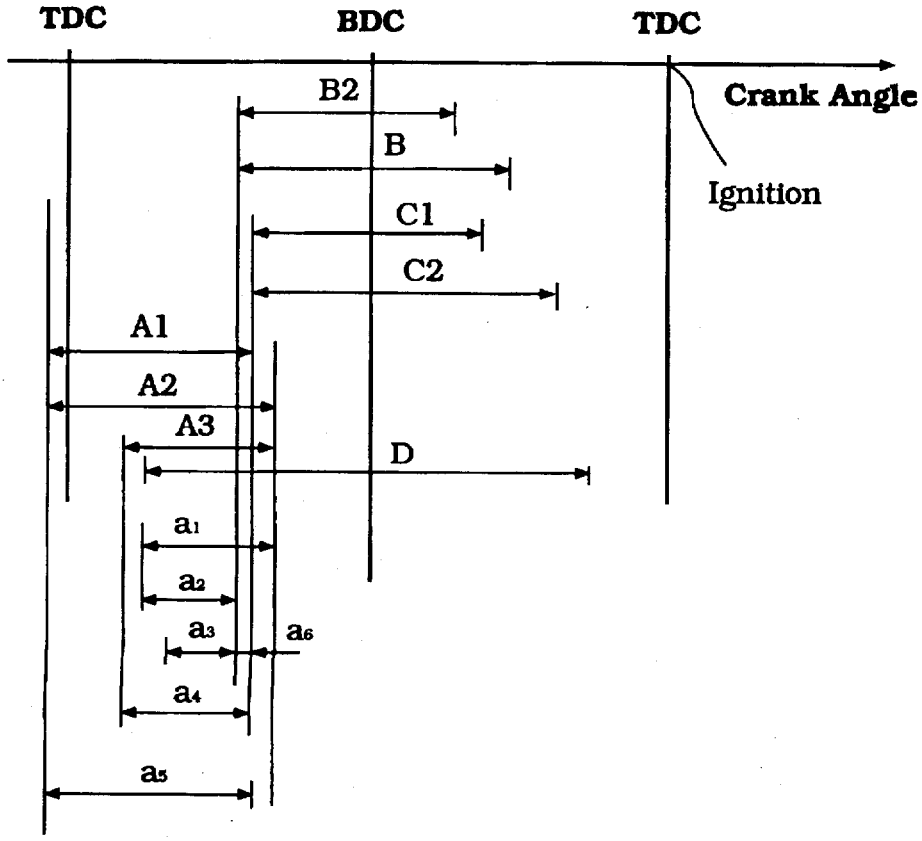

A1: Period of time from ignition till opening of the scavenging port.
A2: Period of time from ignition till scavengine flow reaches the induction port.
A3: Period of time from the completion of combustion till scavenging flow reaches the induction port.
B: Opening period of main exhaust port.
B2: Opening period of main exhaust port.
C1: Opening period of the sub and main scavenging ports (type 1).
C2: Opening period of the sub and main scavenging ports (type 2).
D: Period of exposure of the induction port to the combustion chamber.
a1: Induction period for the induction method 1 of burnt gas.
a2: Induction period for the induction method 2 of burnt gas.
a3: Induction period for the induction method 3 of burnt gas.
a4: Induction period for the induction method 4 of burnt gas.
a5: Induction period for the induction method 5 of burnt gas.
a6: Induction period for the induction method 6 of burnt gas.

*Figure 4*

AIR FUEL RATIO DETECTING DEVICE AND SYSTEM FOR ENGINES

BACKGROUND OF THE INVENTION

This invention relates to an engine control system and method and more particularly to an improved combustion sensor arrangement for an internal combustion engine.

In the interests of providing good fuel economy, exhaust emission control and preservation of natural resources, considerable emphasis has been placed upon improving the combustion control in internal combustion engines. There has been a demand for a feedback control system that can incorporate a sensor which will sense the actual fuel ratio and/or combustion conditions in the combustion chamber at the time of combustion. If the actual combustion conditions and air fuel ratio can be accurately sensed, then it is possible through feedback control systems to ensure optimum running under a wide variety of engine conditions including transient conditions.

The provision of sensors for sensing the air fuel ratio have problems which are particular to the type of engine which is being operated. For the most part, these sensors either sense the air fuel ratio of the mixture which is delivered to the combustion chamber or the air fuel ratio in the combustion chamber or in the exhaust gases from the combustion chamber. Sensors that sense the air fuel ratio that is delivered to the combustion chamber may, in some regards, be simpler and easier to manage. However, these sensors do not provide an accurate indication of the actual air fuel ratio in the combustion chamber at the time of combustion.

There are a number of reasons for this. In the first instance, if the air fuel ratio is measured at a point remote from the combustion chamber, there is a possibility that the actual air fuel ratio in the chamber may be quite different. This is because of the possibility that fuel may condense in the induction system and, thus, may appear to be richer than it actually is in the combustion chamber under some instances. In addition, the fuel which has condensed may then be swept back into the intake charge and, under this condition, the mixture will actually be richer than the sensor will indicate. These problems are particularly acute when the induction track leading to the combustion chamber is long and passes through areas where condensation are possible. This is a particular problem with two-cycle crankcase compression engines.

If the sensor is actually positioned in the combustion chamber, then the sensor should be located in the such a manner that it will be representative of the actual charge in the combustion chamber. In cylinder placement of the sensors presents some problems in that the combustion conditions are quite hostile to sensors. Therefore, it has been the practice to provide a sensor which is in the exhaust system quite close to the combustion chamber, for example, in the actual exhaust port.

Exhaust port sensors frequently are of the $O_2$ type which will provide a signal indicative of the residual oxygen in the exhaust gases. From this, it is possible to determine the air fuel ratio that has been burned in the combustion chamber.

Although exhaust system sensors are quite practical with four-cycle engines, they are not so practical with two-cycle engines. The reason for this is that the two-cycle engine, as is well known, has in addition to combustion occurring in the combustion chamber also experiences scavenging at the same time. That is, toward the end of the combustion cycle, when combustion is likely to be most complete, there also is a fresh fuel air charge entering the combustion chamber so as to scavenge the burnt charge from the combustion chamber. Any mixing of the fresh and burnt charges will provide readings which are clearly inaccurate and not indicative of the actual combustion conditions.

It is, therefore, a principal object of this invention to provide an improved combustion condition sensor for a two-cycle internal combustion engine.

It is a further object of this invention to provide a combustion condition sensor arrangement for a two-cycle internal combustion engine wherein the sensor will be constructed and operated in such a way as to avoid contact with the scavenging air flow in the combustion chamber.

Although arrangements have been made for positioning the sensor in the cylinder or in the exhaust system in such a location wherein they will be protected from contact with the scavenging air flow, various running conditions can change the scavenging conditions and these previously proposed systems have not been totally effective in sampling only the combustion products.

It is, therefore, a still further object of this invention to provide an improved combustion gas sampler for a two-cycle engine that will provide accurate indications under all running conditions of the actual air fuel ratio in the combustion chamber that has been burned.

SUMMARY OF THE INVENTION

This invention is adapted to be embodied in a combustion condition sensor and method of sensing combustion condition for an internal combustion engine. The engine has a combustion chamber, an exhaust port for discharge of exhaust products from the combustion chamber to the atmosphere and a scavenging port for delivering at least a fresh air charge to the combustion chamber. A sensor chamber is provided in which a combustion condition sensor is received for sensing the condition of the gases therein.

In accordance with a method for practicing the invention, the sensor chamber is selectively communicated with the combustion chamber only at times when combustion products will flow into the sensor chamber.

In accordance with an apparatus for performing the invention, control valve means are provided for selectively communicating the sensor chamber with the combustion chamber for permitting only combustion products to flow into the sensor chamber.

BRIEF DESCRIPTION OF THE DRAWINGS

FIG. 4 is a timing chart for one combustion cycle for the engine and used to explain certain embodiments of the invention.

DETAILED DESCRIPTION OF THE PREFERRED EMBODIMENTS OF THE INVENTION

Figure 1:
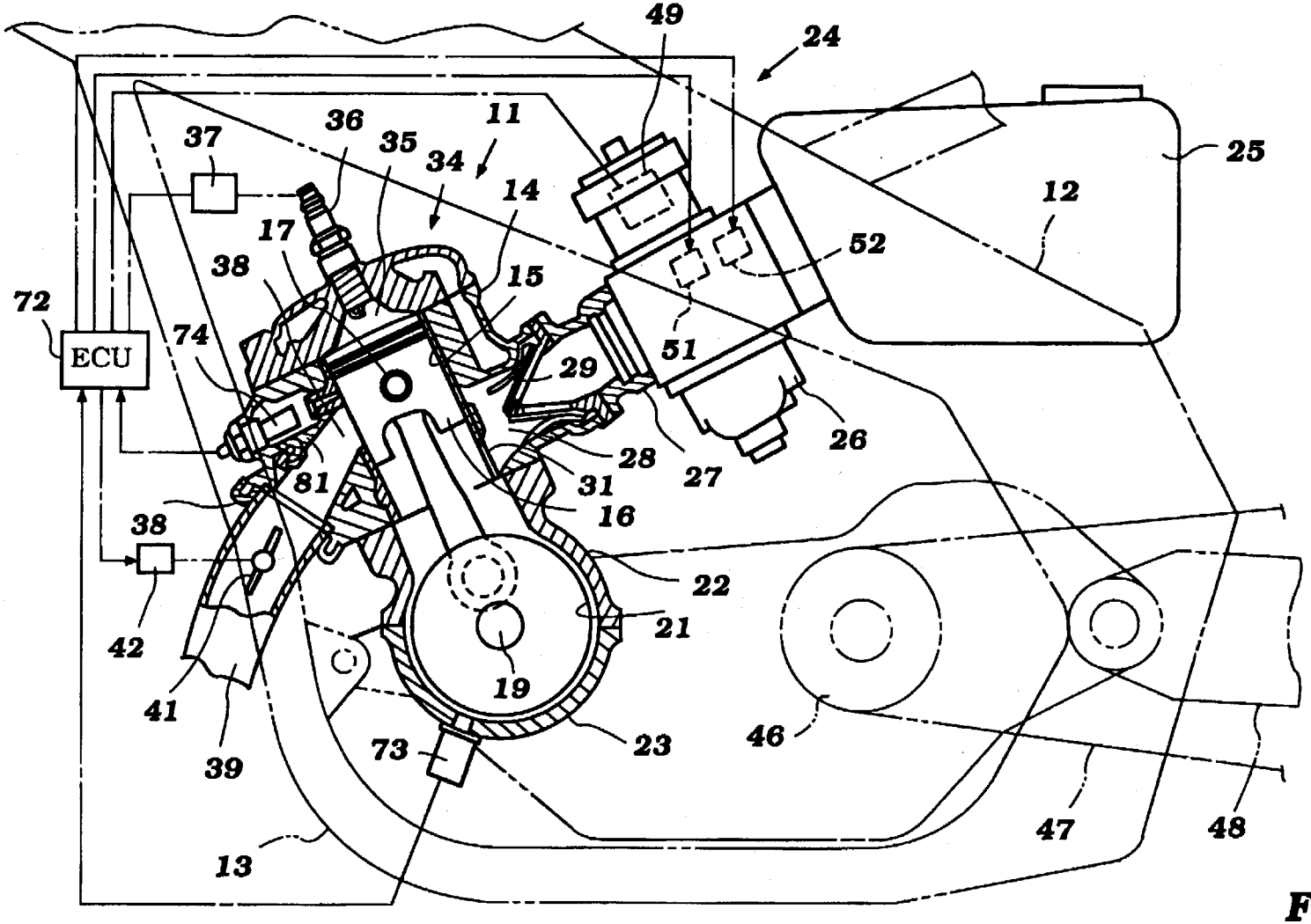
FIG. 1 is a side elevational view of a motorcycle, shown in phantom, powered by an internal combustion engine constructed in accordance with an embodiment of the invention and with portions of the engine shown in cross-section.

Referring now to the drawings and initially to FIG. 1, an internal combustion engine constructed in accordance with an embodiment of the invention is indicated generally by the reference numeral 11. The engine 11 is a two-stroke crankcase compression type engine with a single cylinder though it will be readily apparent to those skilled in the art how the invention may be employed with engines of various other configurations. The engine 11 powers a motorcycle which is shown partially and in phantom and is mounted to the motorcycle's perimeter style frame consisting of a main tube 12 and down tube 13 in any known manner.

The engine 11 is composed of a cylinder block 14 in which a single cylinder bore 15 is formed. A piston 16 reciprocates in the cylinder bore 15 and is connected by means of a piston pin 17 to the small end of a connecting rod 18. The big end of the connecting rod 18 is journaled on the throw of a crankshaft 19 which is rotatably journaled within a crankcase chamber 21.

The crankcase chamber 21 is formed by an upper crankcase member 22, affixed to the lower surface of the cylinder block 14, and a lower crankcase member indicated by the reference numeral 23. The lower crankcase member 23 is affixed to the lower surface of the upper crankcase member 22 in any known manner.

A fuel air charge is delivered to the crankcase chamber 21 by an induction and charge forming system that is indicated by the reference numeral 24 and includes an airbox 25. The airbox 25 delivers a supply of atmospheric air to a charge former, namely a carburetor, that is indicated by the reference numeral 26 and will be described in detail later. The carburetor 26 delivers the air fuel mixture through an intake manifold 27 to an intake port that is disposed along the rearward side of the cylinder block 14 and indicated by the reference numeral 28. A reed type check valve 29 is positioned in the intake port 28 and operates to preclude reverse flow.

Figure 2:
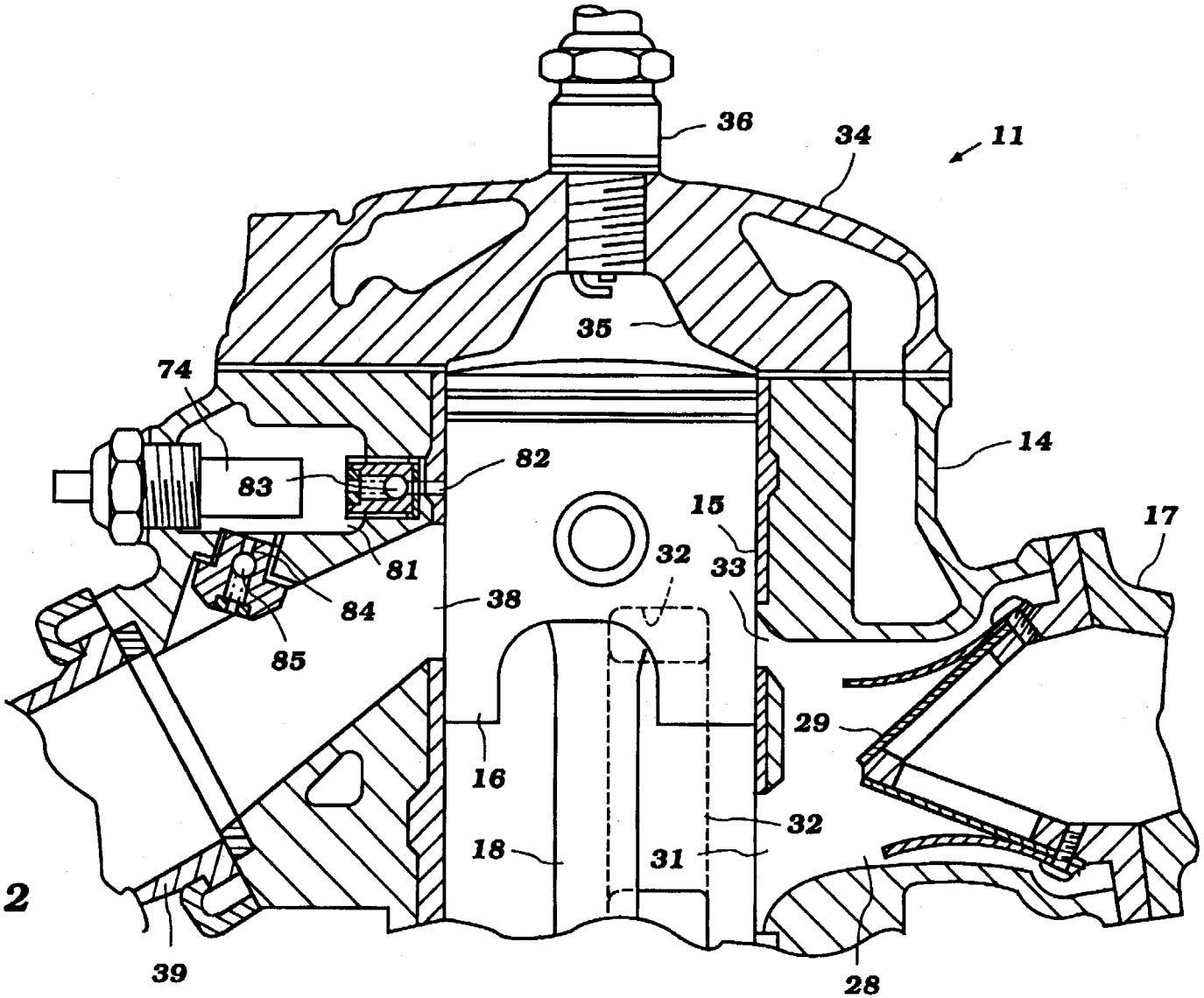
FIG. 2 is an enlarged cross sectional view of a portion of the engine.

With reference now additional to FIG. 2, the inducted air fuel mixture is drawn through an intake port inlet 31 into the crankcase chamber 21 upon upward movement of the piston 16 and then is compressed upon downward piston movement. At this time, the reed valve 29 closes to permit the charge to be compressed in the crankcase chamber 21. The compressed charge is then transferred to the area above the piston 16 through a scavenge port that is indicated by the reference numeral 32 and is shown in phantom in FIG. 2.

The intake port 28 has a branch part 33 that communicates directly with the cylinder bore 15 when the piston 16 is at the lower portion of its stroke to improve breathing and scavenging.

A cylinder head 34 is affixed to the top surface of the cylinder block 14 in closing relation to the cylinder bore 15 in any known manner. The cylinder head 34 defines a recess 35 which forms part of the engine combustion chamber. A spark plug 36 is mounted in the recess 35 and is fired by an ignition control circuit 37 in a known manner. The ignition control circuit 37 is controlled in a manner to be described later.

An exhaust port indicated by the reference numeral 38 is disposed along the forward side of the cylinder block 14 and is served by an exhaust manifold 39 in which is positioned an exhaust control valve 41. The exhaust control valve 41 is driven by an actuator 42 which is controlled in a manner to be described later.

Figure 12:
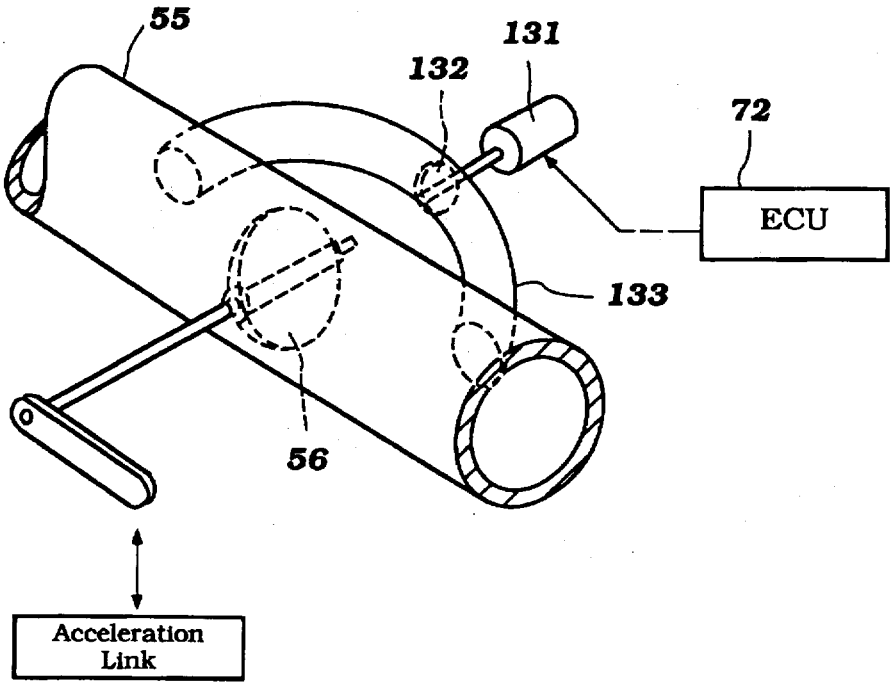
FIG. 12 is a perspective view which illustrates a further control means for the throttle valve of a carburetor which may be used with the invention.

As seen in FIG. 12, the exhaust manifold 39 opens to a muffler 43 in which is disposed silencing baffles and a catalytic bed 44. The combustion products are discharged through the exhaust port 38, through the exhaust manifold 39 and into the muffler 43 where they are purified by the catalytic bed 44 before being released to the atmosphere. The exhaust gases may also be further purified by a means which will be discussed in detail later.

Referring again to FIG. 1, a gearbox 45 is formed integrally within the rearward portions of the crankcase members 22 and 23 and houses a change speed transmission (not shown). The input shaft of the change speed transmission is driven by the crankshaft 19 through a clutch which is also not shown. The output shaft of the transmission drives a sprocket 46 which, in turn, drives a chain 47. The chain 47, in turn, drives the rear wheel (not shown) of the motorcycle which is rotatably journaled upon a trailing arm 48 at its rearward end. The front end of the trailing arm 48 is pivotally connected to the rear of the frame.

The carburetor 26 has an operator controlled throttle valve indicated schematically at 49. This may be of the sliding piston type, or as will be discussed with other embodiments, a butterfly type. In addition the carburetor 26 has a fuel supply amount control 51 and an air supply control 52. By adjusting the fuel and air supply amounts by the controls 51 and 52, respectively, the air fuel ratio may be adjusted to the desired value.

Figure 3:
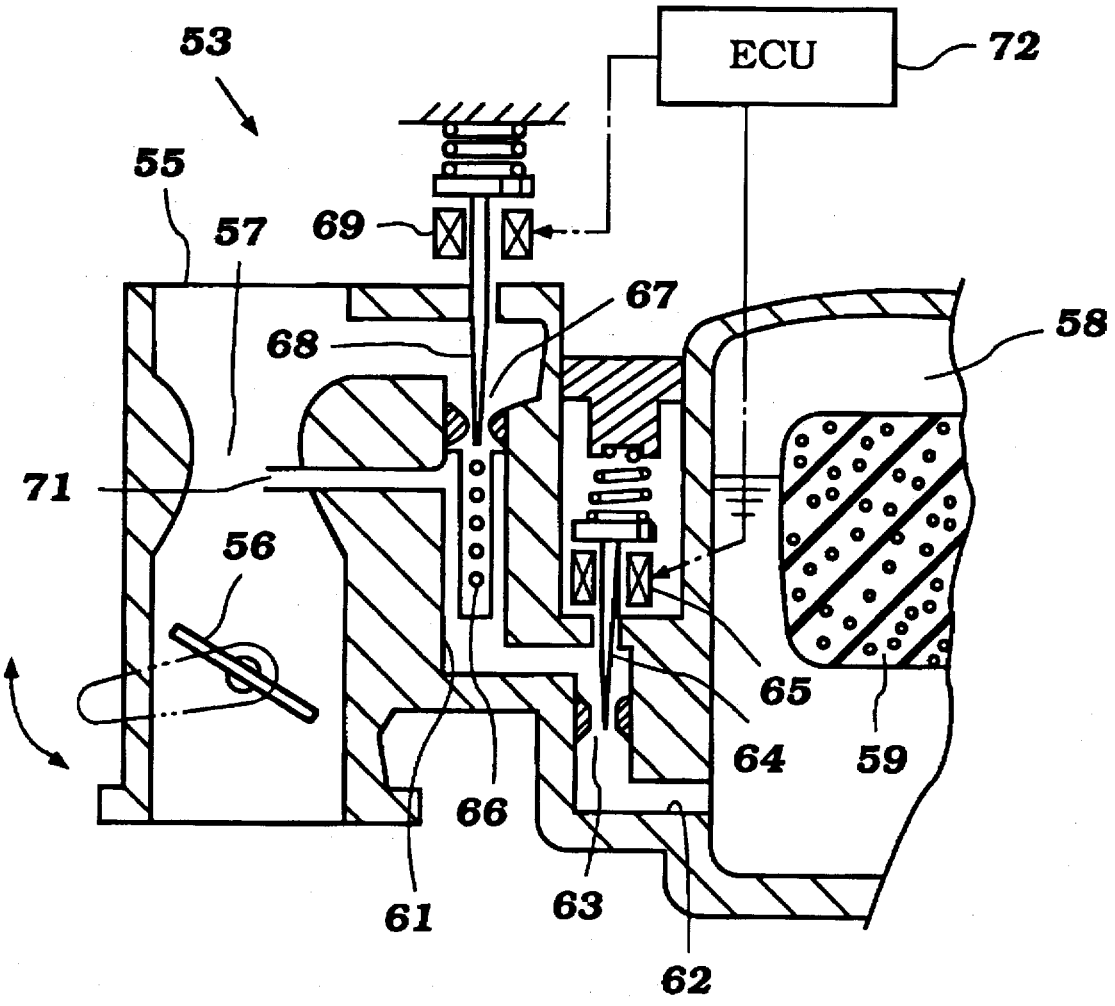
FIG. 3 is a cross-sectional view of a carburetor that may be utilized with the invention.

A specific charge former or carburetor with which the invention may be utilized will now be discussed in detail with reference to FIG. 3. This figure shows a downdraft type, fixed venturi carburetor constructed to utilize the invention, indicated generally by the reference numeral 53, and constructed to utilize the invention. The carburetor 53 is comprised of an outer housing 54 in which is formed an air passage 55 that receives air from the airbox 25. An operator controlled butterfly type throttle valve 56 is pivotally mounted within the air passage 55 downstream of a venturi section 57 and controls the amount of air that flows through the passage 55.

A float bowl 58 is also formed within the housing 54 and receives a supply of fuel from a fuel tank (not shown) through a conduit that also is not shown. A float 59 is positioned inside the float bowl 58 and controls the level of fuel in the float bowl 58 through a needle valve (not shown).

The float bowl 58 serves a main fuel well 61 through a conduit 62 in which a main metering jet 63 and control needle valve 64 are provided. This needle valve 64 is controlled in a manner to be described by a solenoid winding 65 and conforms to the fuel control supply control amount 51 in the embodiment of FIG. 1.

An emulsion tube 66 depends into the main fuel well 61 and receives air from an air bleed jet 67. An air control needle valve 68 controls the amount of bleed air entering the emulsion tube 66. This air bleed needle valve 68 is also controlled by a solenoid 69 in a manner to be described and thus conforms to the air supply control amount device 52 in FIG. 1. The bleed air is drawn from the intake passage 55 upstream of the venturi section 57.

The fuel air emulsion formed in the emulsion tube 66 is discharged through a main jet 71 formed in the venturi section 57. In addition to the main fuel discharge described, the carburetor 53 may incorporate idle and transition discharges of any known types. These may also be controlled in the manner which will be described later.

As noted, the needle valves 64 and 68 are controlled by their respective solenoids 65 and 69. These solenoids 65 and 69 are, in turn, actuated by an ECU that is indicated generally by the reference numeral 72. Thus, the ECU 72 can control the air fuel ratio by manipulating the positions of the needle valves 64 and 68. The control strategy by which this is done will be described later.

As is clear from the above, The ECU 72 is used to control the composition of the intake charge in such a manner as to ensure that the desired air fuel mixture is supplied to the combustion chamber for ignition. In order this accomplish this, the ECU 72 receives signals from a number of sensors and, based on these signals, utilizes a closed loop feedback system to determine the air fuel ratio.

Referring once more to FIG. 1, an engine speed and crank position sensor 73 is disposed in the lower portion of the crankcase chamber 21 and sends a signal to the ECU 72 that is indicative of the angular position of the crankshaft and, by comparison with time, the speed at which the crankshaft 19 is rotating. A throttle valve position sensor is associated with the throttle valve 49 and sends a signal to the ECU 72 that is indicative of the position of the throttle valve 49 and operator demand, while a combustion condition sensor, namely an $O_2$ sensor 74 is disposed in a manner to be described in the cylinder block 14 and sends a signal to the ECU 72 that is indicative of the amount of oxygen present in the exhaust gases and accordingly the air fuel ratio before combustion.

Information supplied to the ECU 72 by the $O_2$ sensor 74 is critical in maintaining an ideal air fuel mixture ratio and in minimizing the exhaust pollutants. Thus, it is obvious that the signal from the $O_2$ sensor 74 must be extremely accurate and reliable in order to ensure the correct operation of the system. This poses some difficulties with a two-stroke engine, since during the exhaust scavenge stroke, it is highly possible that some scavenge air could contact the $O_2$ sensor 74 which would result in a falsely lean mixture signal being sent to the ECU 72.

In accordance with an important feature of the invention this behavior is avoided by disposing the $O_2$ sensor 74 in such a manner that it is isolated from any contaminating scavenge air and, thus, sends signals which are both accurate and reliable to the ECU 72.

Referring now to FIG. 2, a sensor chamber 81 is disposed in the cylinder block 14 immediately above the exhaust port 38. The $O_2$ sensor 74 is positioned inside the chamber 81 and fixed in place by a threaded connection to the cylinder block 14. An exhaust inlet 82 opens to the cylinder bore 15 and communicates to the chamber 81 via a pressure responsive inlet valve which is indicated by the reference numeral 83. An exhaust outlet 84 opens from the sensor chamber 81 and communicates with the exhaust port 38 via an further pressure responsive valve 85.

During an engine power stroke, the downward motion of the piston 16 exposes the exhaust inlet 82 to the combustion chamber 35 prior to exposing the combustion chamber 35 to the scavenge port 32 and branch portion 33 of the intake port 28. At this time, the combustion in the combustion chamber 35 will be substantially completed and the combustion products above the piston 16 are at a pressure of high enough magnitude to open the pressure responsive inlet valve 83 and fill the $O_2$ sensor chamber 81 where the oxygen content of the gases is detected by the $O_2$ sensor 74.

The exhaust valve 85 opens at a pressure somewhat lower than required to open the inlet valve 83. Since the gases in the chamber 81 are still at a pressure sufficiently high to open the pressure responsive valve 85 they are able to exit the chamber 81 through the exhaust outlet 84 and enter the exhaust port 38. As will be described later by reference to FIG. 4, various valve opening pressures and port placements may be employed to obtain the desired exhaust gas sampling without dilution from the scavenging air flow.

Eventually, with the continued downward motion of the piston 16 during the power stroke, the scavenge and branch portion of the intake port 32 and 33, respectively, will be exposed to the combustion chamber 35 and, as a result, a fresh combustion charge will enter and fill the combustion chamber 35.

As noted, this charge could also enter the $O_2$ chamber 81 if its pressure is high enough to hold the pressure responsive valve 83 open and, thus, result in a false lean mixture signal being sent to the ECU 72 by the $O_2$ sensor 74. It is readily apparent, therefore, that the pressure at which the pressure responsive valve 83 opens and closes, henceforth referred to as the threshold pressure $P_r$ must be sufficiently high that the valve 83 is open only by the high in-cylinder pressure present after combustion and is closed in the lower pressure environment present when the scavenging ports are opened.

This threshold pressure $P_r$ is now discussed in more detail with reference to FIG. 4 which is a timing chart for a combustion cycle for the engine 11 and shows several possible variations in sampling possibilities. From FIG. 4, it is seen that ignition occurs slightly before top dead center (TDC). As the piston is driven downwardly by the combustion the inlet port for the chamber 81 opens before either the exhaust port 38 or either of the scavenge ports 33 or 31 open. By delaying the time of opening the inlet port 82, several advantages result. First incompletely burned gasses will not contact the sensor 74. Also the sensor 74 will be protected from the high initial pressures and temperatures that exist in the combustion chamber.

At a time after the inlet port 82 is uncovered by the downward movement of the piston 16, the scavenge ports 33 and 31 will open in sequence. The relative times when these scavenge ports are opened will, of course, depend on their axial spacing along the cylinder bore 15. Even after the ports 33 and 31 are uncovered by the piston 16, there is a delay between their time of opening and the time when the flow actually reaches the inlet port 82 because of the diametrically opposite positions of the ports and flow inertia. This delay after the time of ignition is indicated at A2. Thus there is a delay between the period of time from the completion of combustion until the scavenging flow reaches the inlet port 82 as indicated by A3 and the period of exposure of the sampling inlet port 82 to the combustion chamber 35 is indicated at D. This overlap is the period in which reliable measurements of the exhaust gas contents can be taken by the $0_2$ sensor 74 and is indicated by a1.

Thus, to use this entire time advantageously, the threshold pressure $P_t$ may be set equal to the pressure P1 which exists when the scavenge air reaches the inlet port 82. In this instance, the pressure P1 is also greater than the pressure P2 that exists in the combustion chamber when the piston 16 closes the inlet port 82 on the subsequent upstroke. If the pressure $P_t$ is raised above P1, then there will be a shorter time of induction of combustion products into the chamber 81. That is, the end of the time period A3 will be advanced.

In the case where P2 is greater than P1, then $P_t$ must be raised above P1 and P2 to ensure that no scavenge flow gets into the chamber 81. $P_t$ is, therefore, raised to a pressure P3 which is the in-cylinder pressure at which the exhaust port 38 is exposed and is greater than P1 and P2. The period then available for reliable $O_2$ measurements is indicated by a2 in FIG. 4.

Basically it is desirable to keep the time period when combustion gasses enter the chamber 81 as long as possible to obtain good sampling and effective feed back control. However the sampling time should be such that no scavenge (fresh fuel air mixture) enters the chamber 81 and contacts the sensor 74.

The actual feed back control by which the output of the sensor 74 controls the fuel air ratio by controlling the fuel and air flow amounts as well as the throttle valve may be of any desired or known type. Since the invention here relates primarily to the sensing arrangement, further details of the actual feed back control are not believed necessary to permit those skilled in the art to utilize the invention.

In the embodiment thus far described, the sampling inlet port 82 has been positioned to be exposed to the combustion chamber before the exhaust port 38 is opened. The sampling inlet port may be positioned along the cylinder bore 15 in a location so that it will be uncovered after the exhaust port 38 is opened. If this is done, the position should still be such that the inlet port 82 is uncovered before the scavenge ports 33 and 31 are opened.

Figure 5:
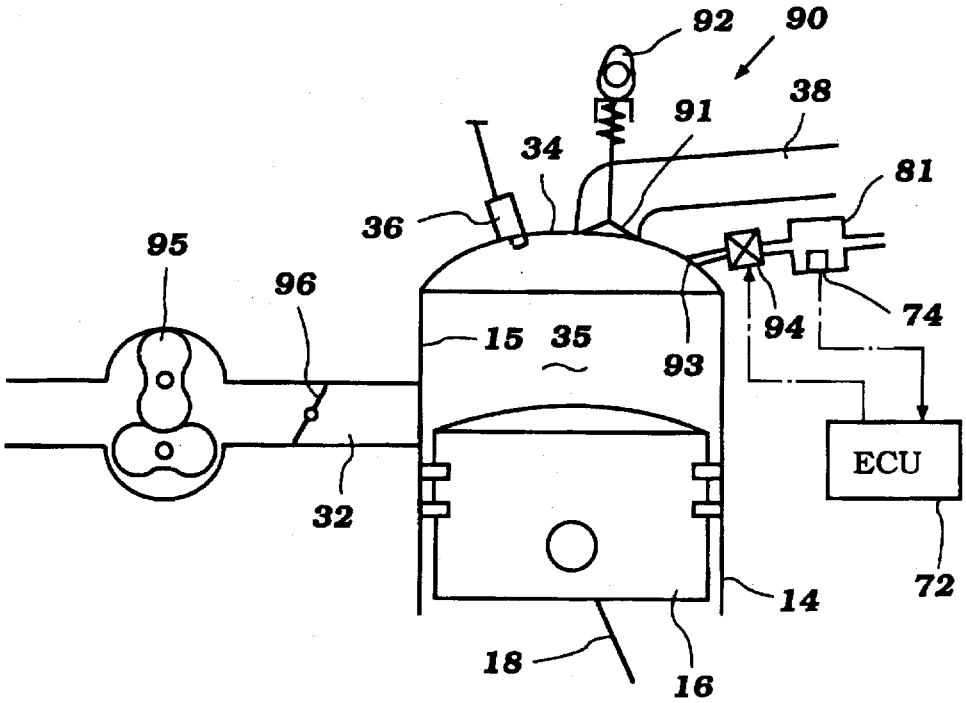
FIG. 5 is a schematic cross sectional view that illustrates an embodiment of the invention.

FIG. 5, is a schematic cross sectional view of a portion of an engine 90 constructed in accordance with another embodiment of the invention. The engine 90 is also a two cycle engine but is not of the crankcase compression type. Where components of the engine 90 are the same or substantially the same as those of the embodiments already described, they are identified by the same reference numerals and will be described again only so far as is required to understand this embodiment.

In this embodiment the exhaust port 38 is positioned in the cylinder head 34 above the combustion chamber 35. The exhaust port 38 is not opened and closed by the piston 16, but rather is controlled by a poppet-type valve 91 that is controlled, in turn, in a known manner by an overhead camshaft 92.

A sub-exhaust or sampling passage 93 in which is positioned a valve 94 that is controlled by the ECU 72 is also disposed in the cylinder head 34 immediately below the exhaust port 38. The sensor chamber and $O_2$ sensor 81 and 74, respectively, are positioned in the passage 93 downstream of the valve 94. Beyond the sensor chamber 81, the passage 93 may either connect to the exhaust port 38 or independently vent to the exhaust system at an appropriate location.

Additionally, a compressor, namely a roots-type supercharger 95 is disposed within the scavenge port 32 upstream of a scavenge valve 96 and is driven off of the crankshaft 19. The fuel charge is introduced by a charge former, which may be of one of the types already disclosed, delivers a fuel charge either upstream or downstream of the supercharger 95.

With this configuration, the opening and closing of the exhaust valve 91 can be made unsymmetrical relative to bottom dead center (BDC) as shown in B2 in FIG. 4. More importantly the opening and closing of the flow to the sensor chamber 81 can be controlled by the ECU 72 and valve 94 in such a manner as to prevent the scavenge flow from reaching the sensor 74 while still assuring that a full charge enters the combustion chamber 35.

These modifications effectively improve the charging efficiency of the engine 90 while still permitting accurate measurements of the exhaust gas oxygen content to be signaled to the ECU 72 which controls the valve 94 and, thus, the period when the measurements are taken. This period may be set as shown in FIG. 4 to a4 in which the valve 94 is opened immediately upon termination of combustion and reliable oxygen measurements are taken by the $O_2$ sensor 74 regardless of the scavenge flow timing.

Because of the improved disposition for the oxygen sensor 74, the exhaust gas measuring period may be set to a3 where measurements may be taken even under such adversarial conditions as reverse flow of the burnt gas in the exhaust port 38 due to exhaust surges, or if the timing till the completion of combustion is extended.

The measuring period may even be extended to cover the duration indicated by a5, even though this means that unburnt charge will enter the sensor chamber 81. This can be corrected by the ECU 72, however, since the scavenge port 32 is not opened during the a5 period and the system is essentially closed. This enables the ECU 72 to calculate accurate correction factors based on the operating conditions of the engine 90.

Figure 6:
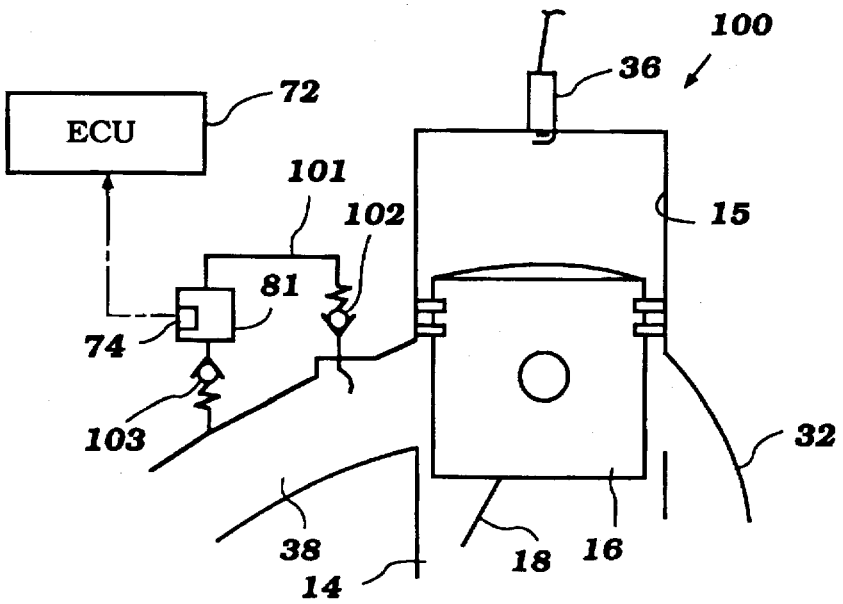
FIG. 6 is a schematic cross sectional view, in part similar to FIG. 5 and illustrates a further embodiment of the invention.

FIG. 6 is a schematic cross sectional view of a portion of an engine 100 which is generally the same as that of FIGS. 1 and 2. Thus like components are identified by the same reference numerals and will be described again only where necessary to understand this embodiment. In this embodiment the engine 100 is of the crankcase compression type and the exhaust port 38 is once again disposed in the cylinder bore 15. The $O_2$ sensor and sensor chamber 74 and 81, respectively, are positioned in a sub-passage 101 that communicates directly with the exhaust port 38 through pressure responsive inlet and outlet valves 102 and 103, respectively.

By referring to FIG. 4, it is seen that the period for $O_2$ measurements to be taken is represented by a6 which is the time between the opening of the exhaust port 38 and the opening of the scavenge port 32. Thus, the threshold pressure $P_t$ for the inlet valve 101 should be set to some value equal to or slightly below the pressure at which the exhaust gases enter the exhaust port 38 while still being greater than the value for the pressure in the exhaust port 38 for scavenged gas charge present. It is readily apparent that $P_t$ for the outlet valve 103 should be set slightly lower than that for the inlet valve 102 so that the combustion gases may exit into the exhaust port 38.

The invention as thus far described has been described by reference to a single cylinder. It is, of course, possible to employ this closed loop feedback control system on engines of a multi-cylinder configuration. While it would be very simple to associate an individual $O_2$ sensor with every cylinder or to utilize the readings from one cylinder to control all cylinders, a system which utilizes only one $O_2$ sensor for sensing multiple cylinders is also possible. Such systems are described below with reference to FIGS. 7 and 8.

Figure 7:
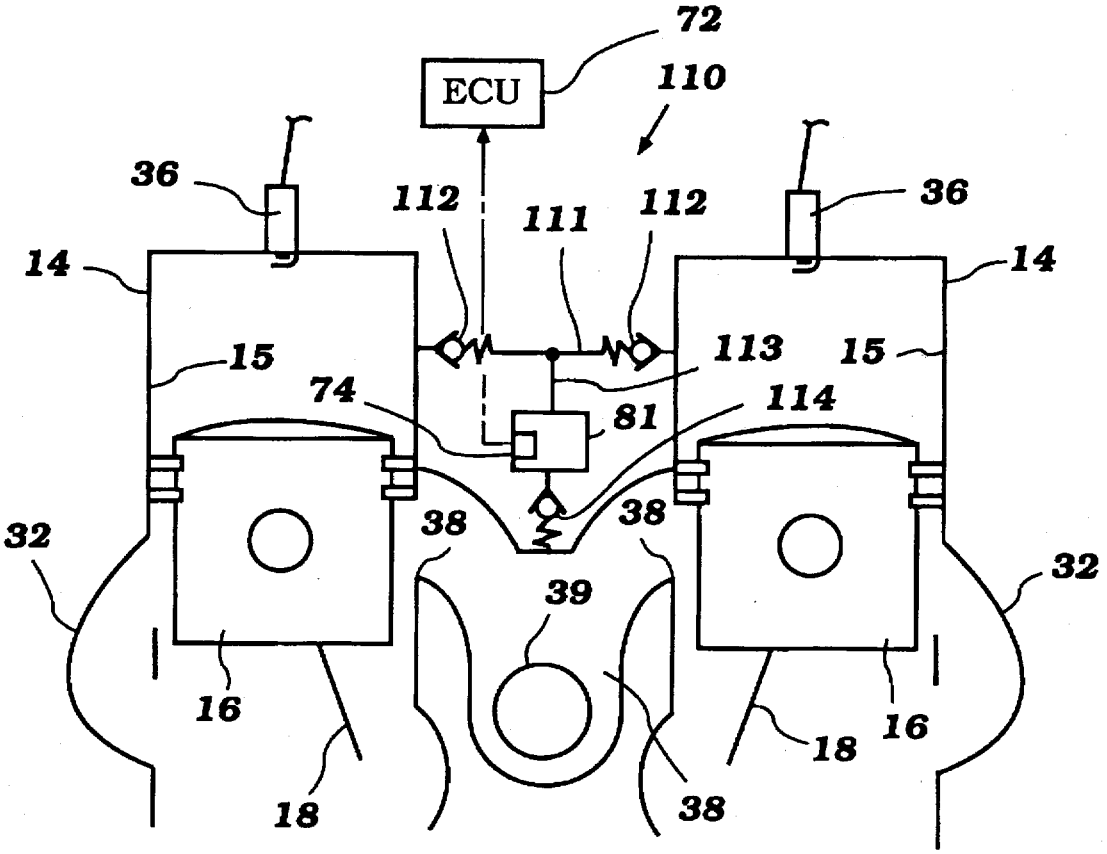
FIG. 7 is a schematic cross sectional view of a portion of an engine with two combustion chambers and illustrates another embodiment of the invention.

Referring first to FIG. 7, a parallel twin two-stroke engine 110 is shown schematically in cross section. Where components are the same as those already described, they are identified by the same reference numerals. The engine 110 is of the crankcase compression type and the respective exhaust ports 38 of the cylinder bores 15 are served by a common exhaust manifold 39. The $O_2$ sensor 74 is disposed in the chamber 81 between the two cylinder bores 15 and adjacent the exhaust ports 38.

An exhaust sub-passage or sensor inlet port 111 opens to each cylinder bore 15 and has the flow through it controlled by respective left and right pressure responsive valves which are indicated by the reference numeral 112. A further passage 113 branches from the sub-passage 112 and serves the single sensor chamber 81 in which the sensor 74 is located. The sensor chamber 81 communicates with the exhaust manifold 39 via a discharge passage in which a pressure responsive valve 114 is positioned.

Figure 8:
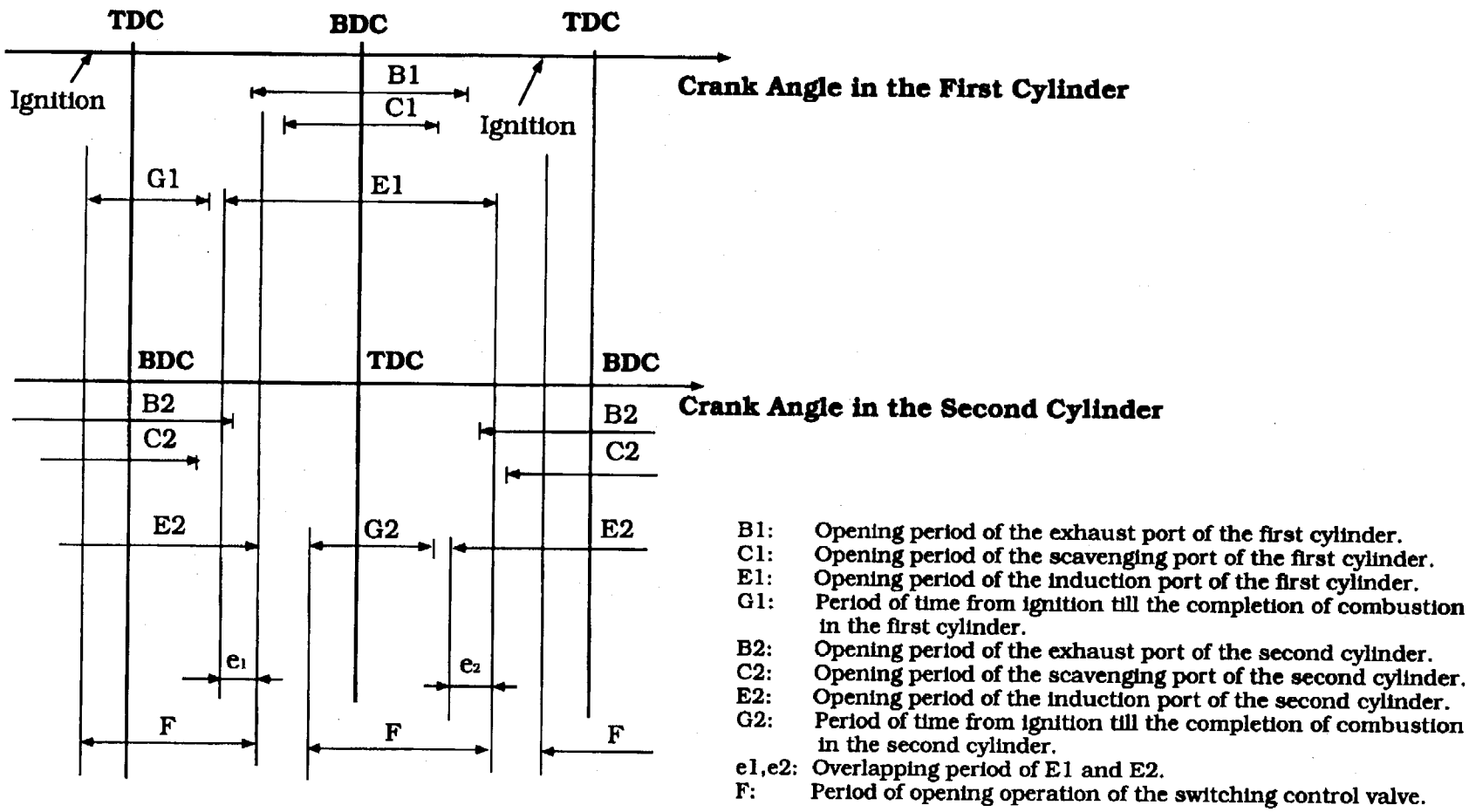
FIG. 8 is a timing chart for the engine of FIG. 7.

The operation of the above-described system is very similar to that for the embodiment illustrated in FIGS. 1 and 2 for a single cylinder design. When the left cylinder 14, as seen in FIG. 8, is on its power stroke, the right cylinder is on its compression stroke. Since the threshold pressure $P_r$ for the pressure responsive valve 112 is set high enough so that the valve 112 will only open during a portion of a power stroke, it is apparent that the left valve will be open while the right valve will remain closed. Thus, the exhaust gases from the left cylinder block 14 will flow past the valve 112 through the passage 111 to the further passage 113, there to have their $O_2$ content measured by the $O_2$ sensor 74 before exiting to the manifold 39.

FIG. 8 illustrates the timing chart for the combustion cycle of a two-cylinder engine. It is seen that the difference before bottom dead center (BDC) between E1, the opening period for the exhaust sub-passage 111 for the cylinder, and C1, the opening period for the scavenge port 32 for the left cylinder, is the period in which no scavenge flow could be present in the exhaust flow entering the sub-passage 111. However, during this time, there is an overlap el where the sub-passage 111 is also open to the right combustion chamber which is compressing an unburnt charge that could produce a false lean mixture measurement under certain engine operating conditions such as transient operation. This problem can be addressed by confining the $O_2$ measurement period to the time between C1 and e1, or by once again employing correction factors for the ECU 72, since the right cylinder back 14 is a closed system whose operating conditions are known.

In the embodiment shown in FIG. 7, there are provided two cylinders each of which communicates with a single sensor 74 in the common sensor chamber 81 that cooperates with each of the cylinder bores 15. It should be understood by those skilled in the art that such an arrangement may be employed in conjunction with more than two cylinders wherein a single sensor and sensing chamber communicates with a plurality of cylinders as long as the timing interval between the cylinders is such that no two cylinders are communicating with the sensor at the same time. In some instances, however, it may also be possible to utilize an arrangement wherein plural cylinders communicate with the sensor at the same time.

Figure 9:
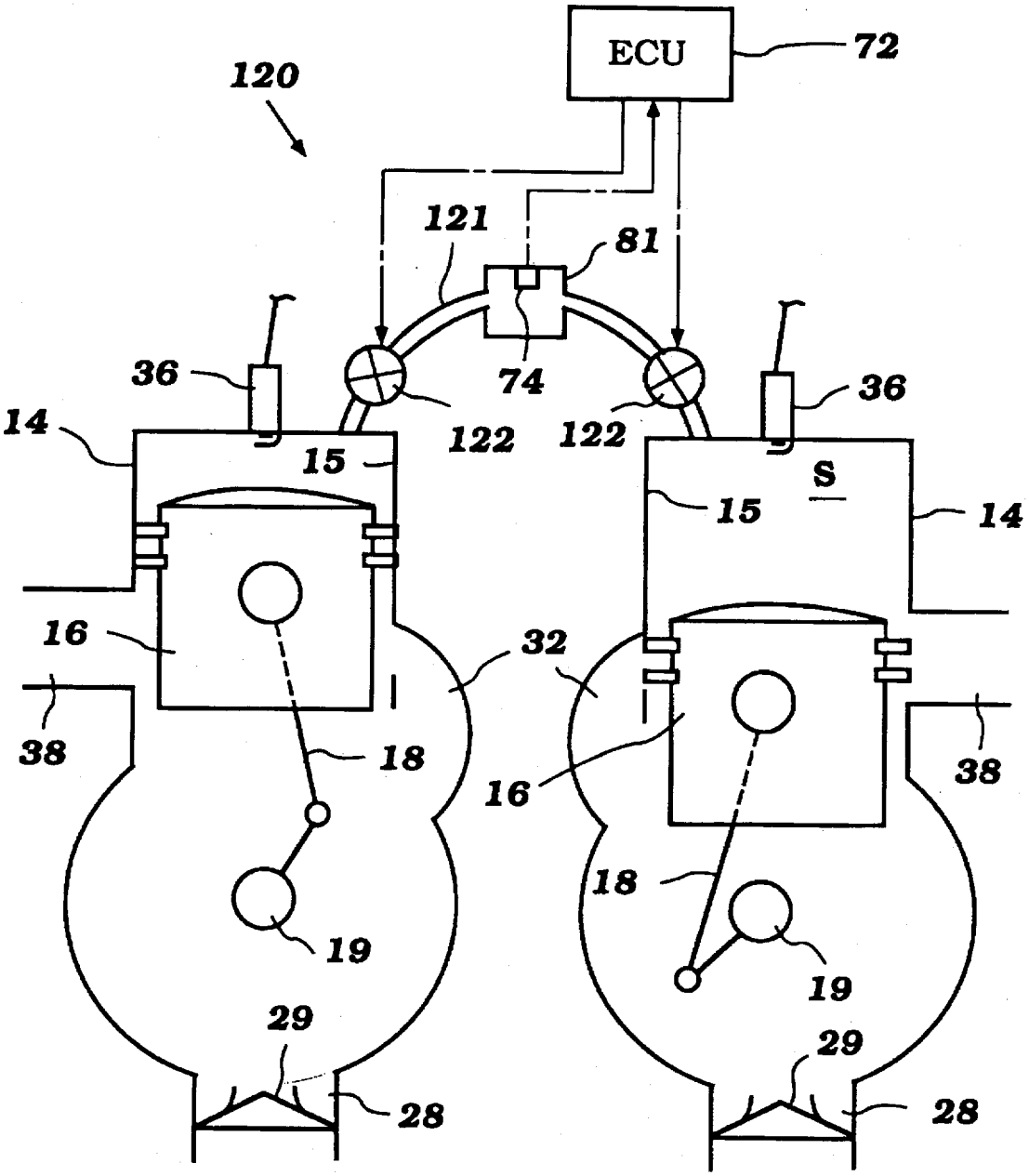
FIG. 9 is a schematic cross sectional view, in part similar to FIG. 7, and illustrates a further embodiment of the invention.

FIG. 9 shows another embodiment of engine, indicated generally by the reference numeral 120. Again where components are the same as those already described, they are identified by the same reference numerals. Like the embodiment of FIG. 7 the engine 120 has two cylinder bores 15 are served by a single $O_2$ sensor 74. The sensor 74 is positioned in a sensor chamber 81 positioned in a sub-exhaust passage 121 that extends from the left cylinder head to the right cylinder head. An ECU controlled valve 122 is positioned at each end of the passage 121 and regulates the flow of exhaust gases from its associated cylinder bore 15 to the $O_2$ sensor 74. Since the passages 121 are controlled by the valves 122 they need not be positioned where they will be opened or closed by the respective piston 16.

In this embodiment the ECU 72 opens both valves 122 simultaneously or near simultaneously such that, when one piston 16 is on its downward expansion stroke, its associated valve 122 opens, while the other valve 122 is simultaneously opened when its associated piston 16 covers both the exhaust and scavenge ports 38 and 32, respectively, thus, forming a closed system until the scavenge port 32 of the first cylinder 14 is uncovered. Between these occurrences, it is readily apparent that the previously described correction means for a closed system may be employed by the ECU 72 in order to accurately determine the $O_2$ content of the burnt air fuel mixture.

Figure 10:
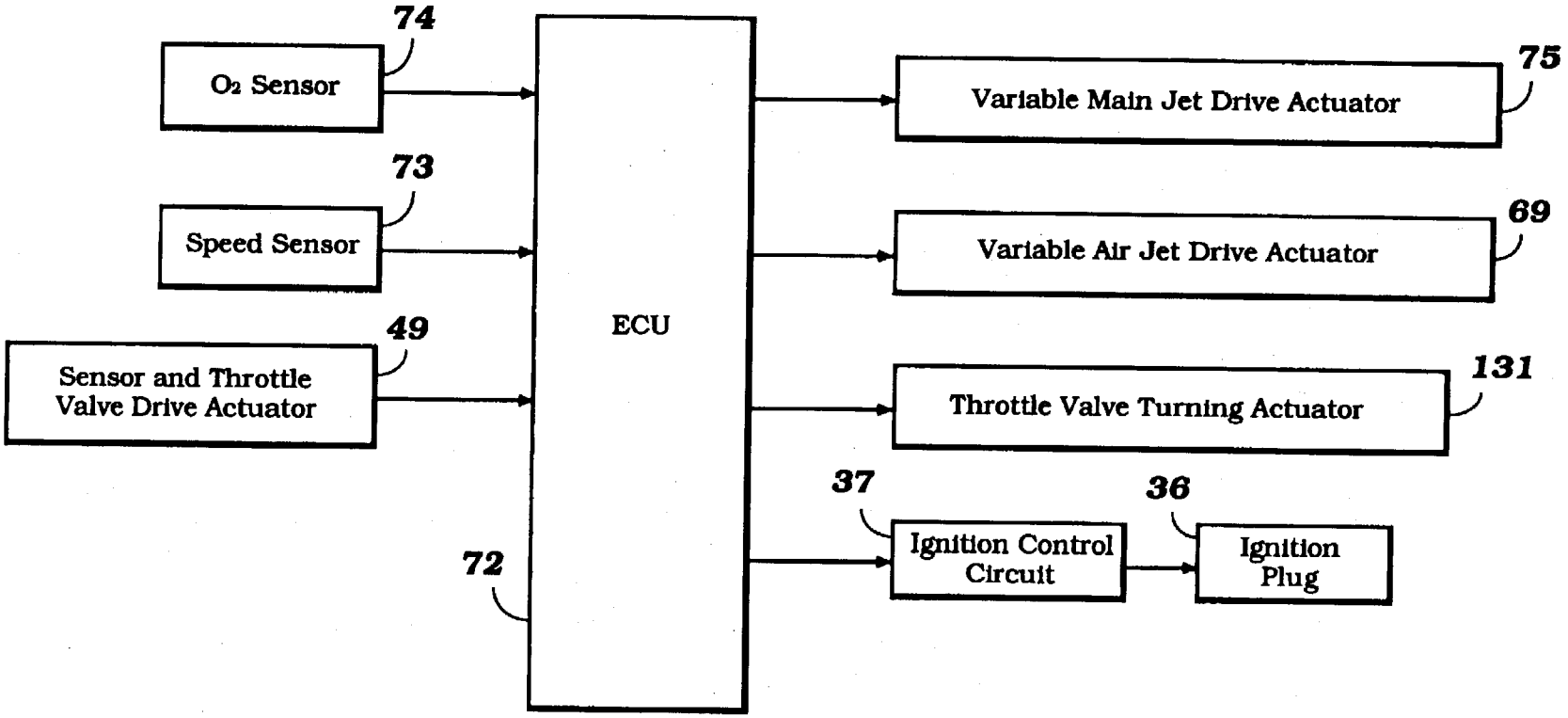
FIG. 10 is a schematic diagram which illustrates the electronic control scheme for practicing the invention.

FIG. 10 shows how the ECU 72 is related to the carburetor control and the various sensors in the embodiments thus far described. As seen in FIG. 10, the signals from the engine speed sensor 73 and throttle position sensor 49 are used by the ECU 72 to determine the ideal air fuel mixture ratio for the given engine running conditions and the spark advance for the next combustion, while the signal from the $O_2$ sensor 74 is used by the ECU 72 to determine if the last combustion occurred with an air fuel mixture of the ideal ratio. If this was not the case, then the ECU 72 may compensate for this discrepancy in the next combustion by signalling the main jet actuator solenoid 75 and the air jet actuator solenoid 69 to operate on the main jet needle 64 and the air jet needle 68 respectively, to the effect of either enriching or leaning the mixture as desired.

For example, if the previous combustion cycle was determined by the ECU 72 to have been too lean, then depending on the operating conditions for the engine 11 the ECU 72 could either increase the fuel content in the next combustion charge by signalling the main jet actuator solenoid 65 to raise the main jet needle valve 64 and thus allow more fuel into the passage 55, or decrease the amount of air in the next combustion charge by signalling the air jet actuator solenoid 69 to lower the needle valve 68 and thus reduce the air content in the combustion charge.

Figure 11:
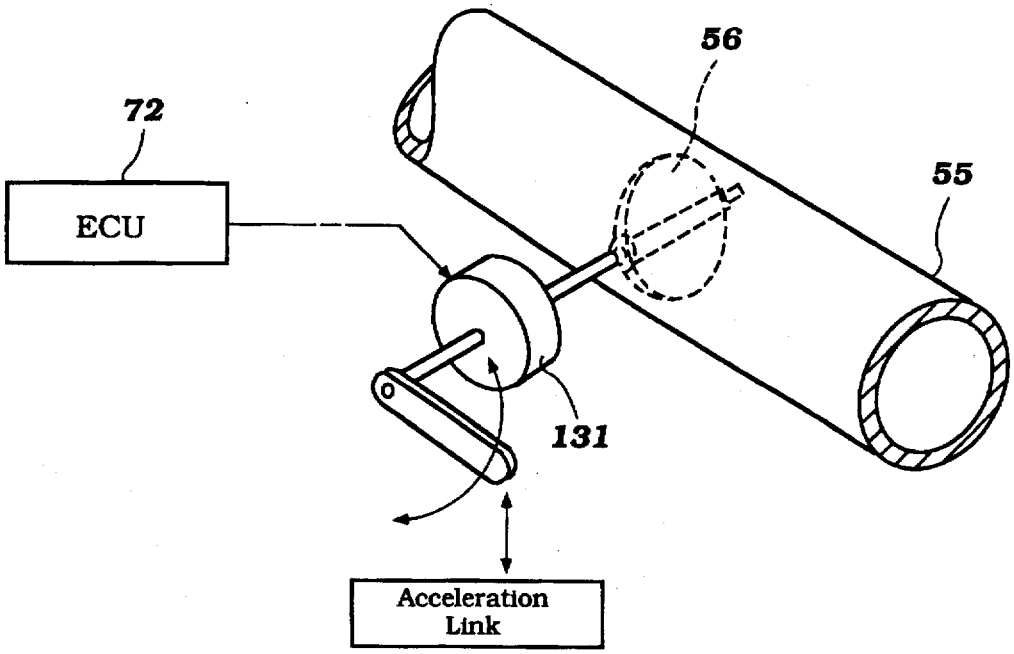
FIG. 11 is a perspective view which illustrates a control means for the throttle valve of a carburetor which may be used with the invention.

The ECU 72 may be employed as the controller of additional apparatus used singly or in conjunction with the carburetors described above to alter the air fuel mixture ratio. For example and as shown in the embodiment of FIG. 11, an actuator 131 controlled by the ECU 72 operates on the throttle valve 56 which is positioned in the air passage 55 upstream of the point where the fuel is added. This connection is interposed in the connection of the operator controlled actuator link to the throttle valve 56 to modify the position from that called for by the operator. In this manner, with respect to FIG. 10, the amount of air in the mixture can be controlled by the ECU 72 by rotation of the throttle valve 56 by the actuator 131, this motion being independent from any throttle motion being inputted by an operator.

FIG. 12 shows another possible air flow control method in which the actuator 131 operates a second throttle valve 132 which is positioned in a sub-passage 133 whose inlet is upstream of the operator control throttle valve 56 and whose outlet is downstream thereof. Thus, it is readily apparent that, regardless of the means, the ECU 72 is employed to control the air fuel ratio of the charge entering the crankcase chamber 21 from the carburetor 26. This ratio, as determined by the ECU 72 is the ideal stoichiometric ratio for optimum combustion with minimum pollutants.

Figure 13:
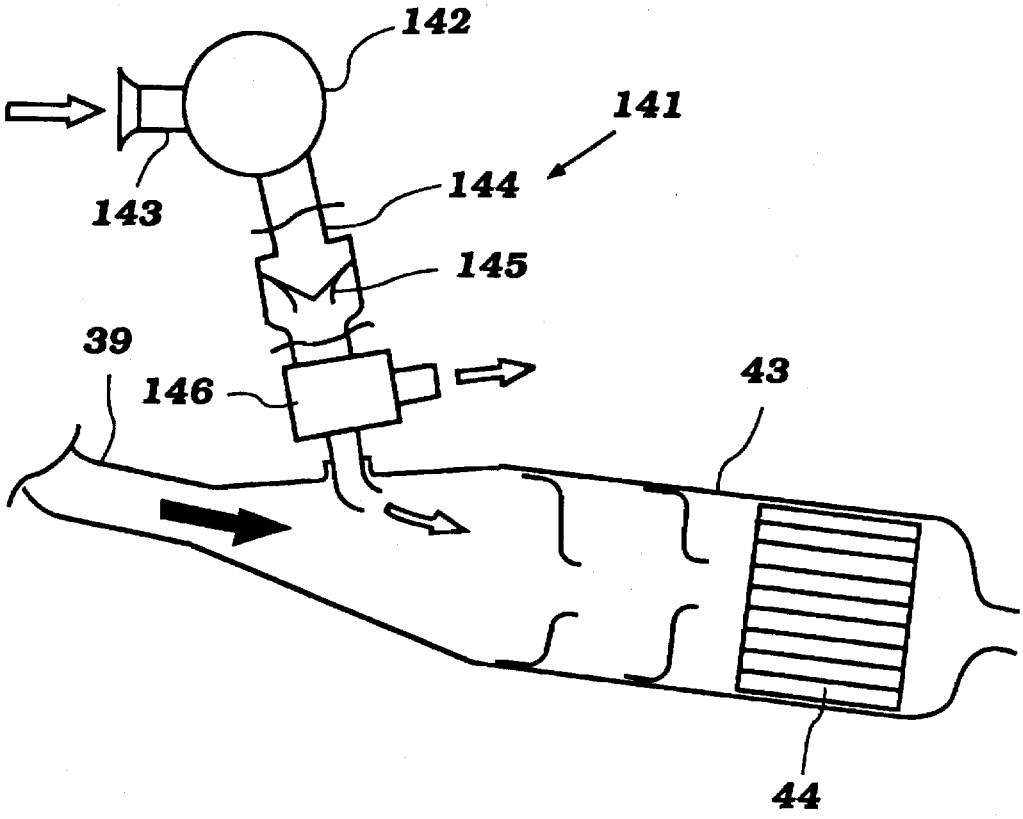
FIG. 13 is a schematic cross sectional view that illustrates a portion of the exhaust system constructed in accordance with an embodiment of the invention.

The ECU 72 can also be further used to further control the exhaust emissions of the engine 11 as shown in previously referred to FIG. 13. With reference to FIG. 13, an exhaust purification assembly is indicated generally by the reference numeral 141 and is composed of a blower 142 that is driven by the engine 11 and receives a supply of atmospheric air from a secondary air passage 143. From the blower 142, the air supply passes through a further passage 144 in which is positioned a one-way reed-type check valve 145 and a regulator valve 146 that is controlled by the ECU 72. The passage 144 opens to the muffler 43 where the air mixes with the exhaust products in a proportion as determined by the ECU 72 that is calculated to raise the oxidation efficiency of the hydrocarbons and carbon monoxide in the exhaust gas. Thus, it is seen that the addition of air controlled by the ECU 72 to the exhaust gases serves to reduce the harmful emissions of the engine 11.

Figure 14:
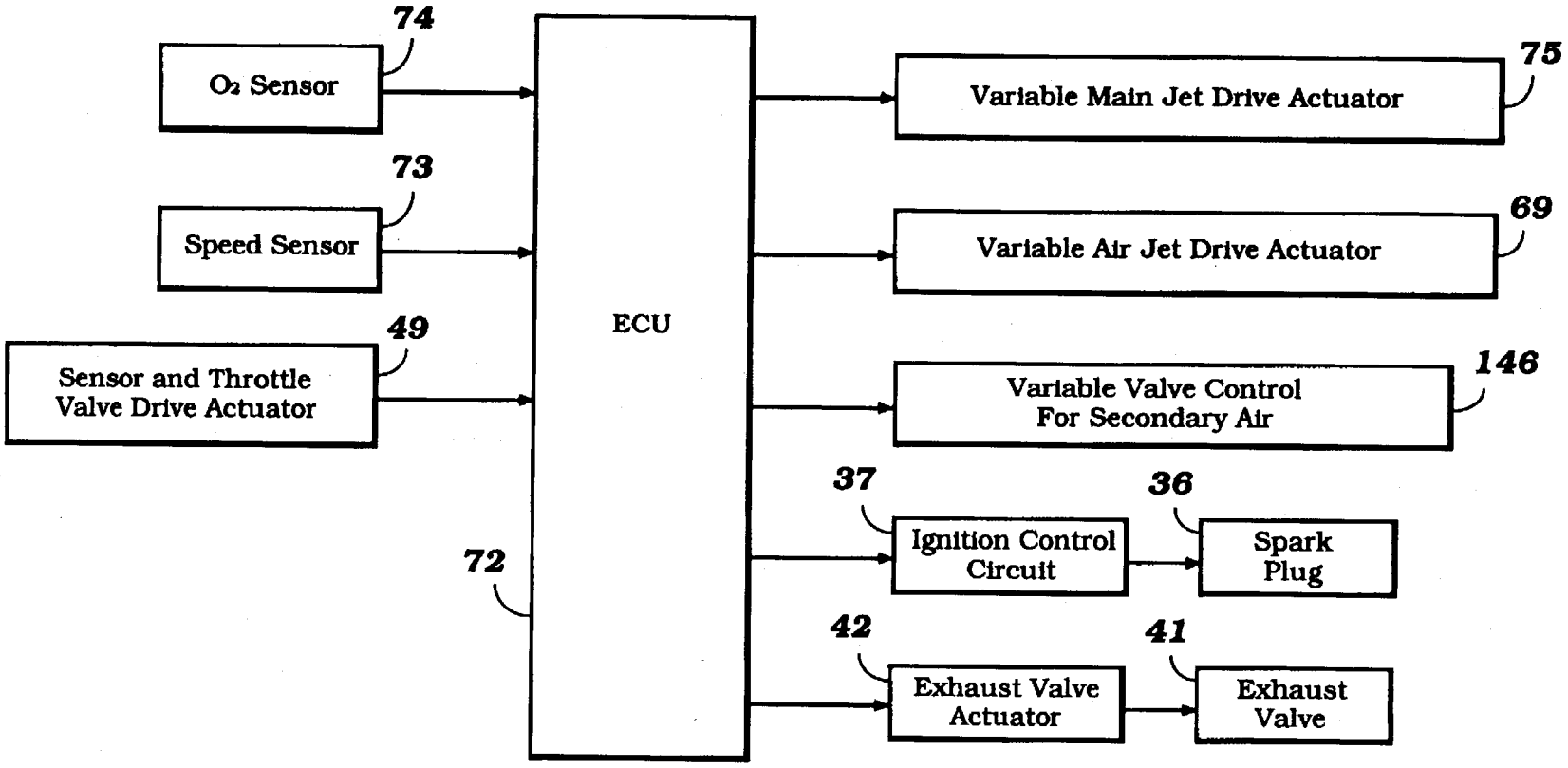
FIG. 14 is a further schematic diagram that illustrates another electronic control scheme for practicing the invention.

Reference was also made in the description of FIG. 1 to the exhaust control valve 41. The strategy and control for this valve will now be described by reference to FIG. 1 and FIG. 14. It will be seen that the signals from the engine speed sensor 73 and throttle position sensor 49 are again used by the ECU 72 to determine the ideal air fuel ratio and the spark advance, and they are also used to determine the best angle for the exhaust valve 41 which is driven by the actuator 42 as controlled by the ECU 72 and whose disposition for a given engine speed serves to boost power output for the engine 11 or control the timing of the entrance of the ensuing fresh combustion charge into the combustion chamber 35. The signal from the $O_2$ sensor 74 is again used to determine if the mixture ratio used in the previous combustion cycle was ideal. If this was not so, the ECU 72 may again compensate for any discrepancy by signalling any or all of the actuators 65, 69 and 131.

The $O_2$ sensor 74 is also used by the ECU 72 to determine the amount of secondary air, if any, to be added to the exhaust system. With respect to FIG. 14, in those instances where the $O_2$ sensor 74 sends a signal to the ECU 72 that is indicative of a lean running condition, then the ECU 72 will signal the regulator valve 146 to open to a degree which permits the amount of air necessary to maximize the oxidation efficiency of the excess hydrocarbons and carbon monoxide enters the muffler 43.

Thus, it is readily apparent that the above-described closed loop feedback control system is able to ensure that the engine 11 is operating with an ideal air fuel mixture ratio and with a minimum of exhaust pollutants.

It should be clear from the above that an $O_2$ sensor can effectively be employed for two-stroke engines in order to form a closed loop feedback system where the air fuel mixture for the engine can be determined by an ECU and compared to an known ideal value. Of course, the foregoing description is that of preferred embodiments of the invention, and various changes and modifications may be made without departing from the spirit and scope of the invention, as defined by the appended claims.

What is claimed is:

1. A combustion condition sensor for an internal combustion engine having a combustion chamber, an exhaust port for discharging exhaust products from said combustion chamber to the atmosphere, a scavenging port for delivering at least a fresh air charge into said combustion chamber, a sensor chamber, a combustion condition sensor received in said sensor chamber for sensing the condition of the gases therein, and control valve means for selectively controlling the communication of said sensor chamber with said combustion chamber for permitting only combustion products to flow into said sensor chamber.

2. A combustion condition sensor as set forth in claim 1, further including passage means for communicating the sensor chamber with the atmosphere.

3. A combustion condition sensor as set forth in claim 2, further including control valve means for controlling the communication of the sensor chamber with the atmosphere.

4. A combustion condition sensor as set forth in claim 3, wherein the sensor chamber is communicated with the atmosphere through an exhaust system of the engine.

5. A combustion condition sensor as set forth in claim 1, wherein the control valve means is controlled in responsive to engine operating conditions.

6. A combustion condition sensor as set forth in claim 5, wherein there is provided an exhaust valve for opening and closing the exhaust port.

7. A combustion condition sensor as set forth in claim 6, wherein the exhaust port and the sensor chamber communicate with the combustion chamber through a cylinder head of the engine.

8. A combustion condition sensor as set forth in claim 7, wherein the engine is provided with a compressor for delivering scavenging air to the combustion chamber under pressure.

9. A combustion condition sensor as set forth in claim 1, wherein the control valve means comprises a pressure responsive valve.

10. A combustion condition sensor as set forth in claim 9, wherein the control valve means is provided in a passage formed in the combustion chamber from a point adjacent the exhaust port.

11. A combustion condition sensor as set forth in claim 10, wherein the passage in which the control valve means is provided is opened and closed at least at times by the cyclic operation of the combustion chamber.

12. A combustion condition sensor as set forth in claim 11, wherein the communication with the sensor chamber is opened before the exhaust port is opened and is closed after the exhaust port is closed.

13. A combustion condition sensor as set forth in claim 9, wherein the sensor chamber communicates with the combustion chamber through the exhaust port.

14. A combustion condition sensor as set forth in claim 13, further including control valve means for controlling the communication of the sensor chamber with the atmosphere.

15. A combustion condition sensor as set forth in claim 14, wherein the sensor chamber is communicated with the atmosphere through an exhaust system of the engine.

16. A combustion condition sensor as set forth in claim 1, wherein the engine is provided with a pair of combustion chambers each having an exhaust port and a scavenge port, and wherein a single sensor chamber communicates with both of the combustion chambers through respective passages in which control valves are provided.

17. A combustion chamber sensor as set forth in claim 16, wherein the engine has a plurality of combustion chambers all communicating with a single sensor chamber through respective passages and control valves.

18. A combustion condition sensor as set forth in claim 17, wherein the sensor chamber discharges into the atmosphere.

19. A combustion condition sensor as set forth in claim 18, wherein the sensor chamber discharges into the atmosphere through the exhaust system for the engine.

20. A combustion condition sensor as set forth in claim 16, wherein a single combustion condition sensor is provided in the sensor chamber for both of the combustion chambers.

21. A combustion condition sensor as set forth in claim 20, further including engine condition responsive means for controlling the communication of the sensor chamber with each of the combustion chambers.

22. A combustion condition sensor as set forth in claim 20, wherein pressure responsive means control the communication of the sensor chamber with each of the combustion chambers.

23. A combustion condition sensor as set forth in claim 22, wherein the sensor chamber discharges into the atmosphere.

24. A combustion condition sensor as set forth in claim 23, wherein the sensor chamber discharges into the atmosphere through the exhaust system for the engine.

* * * * *